US012446633B1

(12) United States Patent
Wan

(10) Patent No.: US 12,446,633 B1
(45) Date of Patent: Oct. 21, 2025

(54) BRA CUP WITH CUT HOLES STRUCTURE AND BRASSIERE

(71) Applicant: Grand Gain Industrial Limited, Hong Kong (CN)

(72) Inventor: Hoyau Wan, Hong Kong (CN)

(73) Assignee: Grand Gain Industrial Limited, Hong Kong (CN)

( * ) Notice: Subject to any disclaimer, the term of this patent is extended or adjusted under 35 U.S.C. 154(b) by 0 days.

(21) Appl. No.: 18/732,154

(22) Filed: Jun. 3, 2024

(30) Foreign Application Priority Data

Apr. 3, 2024 (CN) ..... 202420692183.7

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
See application file for complete search history.

(56) References Cited

U.S. PATENT DOCUMENTS 2,659,085 A * 11/1953 Ericson ..... A41C 3/0014 450/39
2,748,771 A * 6/1956 Richards ..... A41C 3/04 450/36
4,214,120 A * 7/1980 Jones, Jr. ..... H01L 23/49811 257/676
6,299,505 B1 * 10/2001 Huang ..... A41C 3/144 450/57
6,306,006 B1 * 10/2001 Cheng ..... A41C 3/10 450/57
6,398,620 B1 * 6/2002 Huang ..... A41C 3/144 450/57
6,540,585 B1 * 4/2003 Lee ..... A41C 3/10 450/55
6,811,463 B2 * 11/2004 Martz ..... A41C 3/10 450/38
7,442,110 B2 * 10/2008 Gaudet ..... A41C 3/144 450/39
9,788,579 B2 * 10/2017 Miller ..... A41C 3/0085
10,051,896 B2 * 8/2018 Miller ..... A41C 3/0057
11,432,596 B2 * 9/2022 Kobayashi ..... A41C 3/10
2010/0267312 A1 * 10/2010 Chien ..... A41C 3/144 450/38

* cited by examiner

*Primary Examiner* — Gloria M Hale
(74) *Attorney, Agent, or Firm* — Tucker Ellis LLP

(57) ABSTRACT

Disclosed are a bra cup with cut openings structure and a brassiere. The bra cup with cut openings structure has a first region and a second region. The first region defines a main opening, and a first supporting layer corresponding to the first region defines the largest cut opening, such that the first region has the least supporting material per unit area, and a bra cup with cut openings structure corresponding to the first region has good flexibility. An area of a single opening among several auxiliary cut openings in the second region is smaller than an area of a single opening among several main openings. The reasonable distribution of the cut openings in the first region and the second region makes the bra cup in embodiments of the disclosure have reasonable flexibility distribution, strong supporting ability and high wearing comfort.

18 Claims, 3 Drawing Sheets

BRA CUP WITH CUT HOLES STRUCTURE AND BRASSIERE

CROSS-REFERENCE TO RELATED APPLICATION

This application claims the benefit of Chinese patent application No. 202420692183.7, filed Apr. 3, 2024. The disclosure of Chinese patent application No. 202420692183.7 is hereby incorporated by reference.

TECHNICAL FIELD

The present disclosure relates to the field of underwear supporting technologies, and particularly to a bra cup with cut openings structure and a brassiere.

BACKGROUND

Due to structural characteristics of breasts, the breasts have different supporting requirements for different parts of bra cup. Specifically, upper and front sides of a breast require a small supporting force, and corresponding cup structures of the upper and front sides of the breast require high flexibility, while bottom and side of the breast require a large supporting force, and corresponding cup structures of the bottom and side of the breast require low flexibility and high supporting performance. In the existing technologies, the bra cup is often designed in an integrated way, and there is little difference between an overall flexibility and a supporting strength of the bra cup. If the bra cup has a large overall hardness and a strong supporting force, parts of the bra cup corresponding to the upper and front sides of the breast are easy to press the breast, and if the bra cup has a small overall hardness and a weak supporting force, the supporting forces of the bra cup corresponding to the bottom and side of the breast will be too small to meet the requirement of shaping and supporting the breast, and an overall supporting effect of the bra cup will be reduced accordingly. Therefore, due to unreasonable distribution of flexibility and supporting effect of the bra cup in the existing technologies, the bra cup has poor wearing experience.

SUMMARY

The present disclosure mainly aims to provide a bra cup with cut openings structure and a brassiere, which can improve distribution of flexibility and supporting effect of a cup, and improve wearing comfort of bra cup.

In order to achieve the above objectives, the present disclosure provides a bra cup with cut openings structure. The bra cup has a first base layer and a first supporting layer. The first supporting layer is stacked with the first base layer in a first direction, the first supporting layer is provided with a first region and a second region, the first region is configured for fitting an upper side of a breast, the second region is configured for fitting a bottom side of the breast, the first region is provided with several main openings, the second region is provided with several auxiliary openings, and in a direction perpendicular to the first direction, a projection area of a single opening among the several main openings on the first base layer is not smaller than a projection area of a single opening among the several auxiliary openings on the first base layer.

In some embodiments, the several auxiliary openings include a first set of openings, and the first set of openings is arranged on a side of the main opening close to a front side of the breast.

In some embodiments, the several auxiliary openings include a second set of openings, and the second set of openings is arranged on a side of the main opening close to a side of the breast.

In some embodiments, the several auxiliary openings include a third set of openings, and the third set of openings is arranged on a side of the main opening close to the bottom side of the breast.

In some embodiments, the second direction points from the side of the breast to the front side of the breast, and the second direction is perpendicular to the first direction; where, the several auxiliary openings include a first set of openings, and the first set of openings is arranged on a side of the main opening close to the front side of the breast, and a width of an opening in the first set of openings close to the front side of the breast in the second direction is greater than a width of an opening in the first set of openings far away from the front side of the breast in the second direction.

In some embodiments, the several auxiliary openings include a second set of openings, and the second set of openings is arranged on a side of the main opening close to the side of the breast, and a width of an opening in the second set of openings close to the side of the breast in the second direction is not greater than a width of an opening in the second set of openings far away from the front side of the breast in the second direction.

In some embodiments, the several auxiliary openings include a first set of openings and a second set of openings, the first set of openings is arranged on a side of the main opening close to a front side of the breast, the second set of openings is arranged on a side of the main opening close to a side of the breast, a second direction points from the side of the breast to the front side of the breast, and the second direction is perpendicular to the first direction.

In some embodiments, each of the several main openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening, or a snowflake-shaped opening.

In some embodiments, each of the several auxiliary openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening, or a snowflake-shaped opening.

In some embodiments, the first region has a first stretching rate a, the second region has a second stretching rate b, the first supporting layer further has a third region, the third region is arranged around the first region and the second region, the third region has a third stretching rate c, and the first stretching rate a, the second stretching rate b and the third stretching rate c satisfy that $c \leq b \leq a$.

In some embodiments, the bra cup further includes a second base layer, the second base layer is arranged on a side of the first supporting layer far away from the first base layer, and the second base layer covers the first supporting layer.

In some embodiments, the first base layer includes a first fabric layer, a first foam layer and a first adhesive layer which are stacked, and the first adhesive layer is configured for adhering the first foam layer to the first supporting layer.

In some embodiments, the bra cup includes a first cup body and a second cup body, the first cup body includes the first base layer and the first supporting layer, the second cup body includes a third base layer and a second supporting layer, and the second supporting layer defines a fifth set of openings including a first subset of openings each symmetrically arranged with respect to a respective one of the several main openings, and a second subset of openings each symmetrically arranged with respect to a respective one of the several auxiliary openings.

In a second aspect, the present disclosure further provides a brassiere, and the brassiere includes the bra cup according to any one of the above embodiments.

Compared with the existing technologies, the present disclosure has the beneficial effects as follows.

In the technical solution of the present disclosure, the bra cup has the first region and the second region. The first region defines the main opening, and a first supporting layer corresponding to the first region defines the largest cut opening, such that the first region has the least supporting material per unit area, and the supporting strength of the first region is reduced and the flexibility of the first region is improved. A bra cup with cut openings structure corresponding to the first region has good elasticity, such that the bra cup can embrace and fit the upper side of the breast. An area of the single opening of the auxiliary cut openings in the second region is smaller than an area of the single opening of the main openings. On one hand, the arrangement of the auxiliary openings can reduce the supporting material of the second region, improve the flexibility of the second region, enhance a fitting degree between a bra cup corresponding to the second region and the breast, and reduce the pressing of the bra cup on the breast. On the other hand, compared with the main opening, the area of the single opening of the auxiliary openings close to the bottom side of the breast is small, the first supporting layer has less removed material, and more supporting material per unit area is retained, so that the second region has good flexibility and sufficient supporting effect to the breast at the same time. The reasonable distribution of the cut openings in the first region and the second region makes the bra cup with cut openings structure in embodiments of the present disclosure have reasonable supporting ability, thus greatly improving wearing comfort.

BRIEF DESCRIPTION OF THE DRAWINGS

In order to illustrate technical solutions in embodiments of the present disclosure or in the existing technologies more clearly, the drawings to be used in the descriptions of the embodiments or the existing technologies will be briefly described hereinafter. Obviously, the drawings in the following descriptions illustrate merely some embodiments of the present disclosure, and for those of ordinary skills in the art, other drawings may also be obtained based on the structures shown in these drawings without going through any creative work.

DESCRIPTION OF REFERENCE NUMERALS

Figure 1:
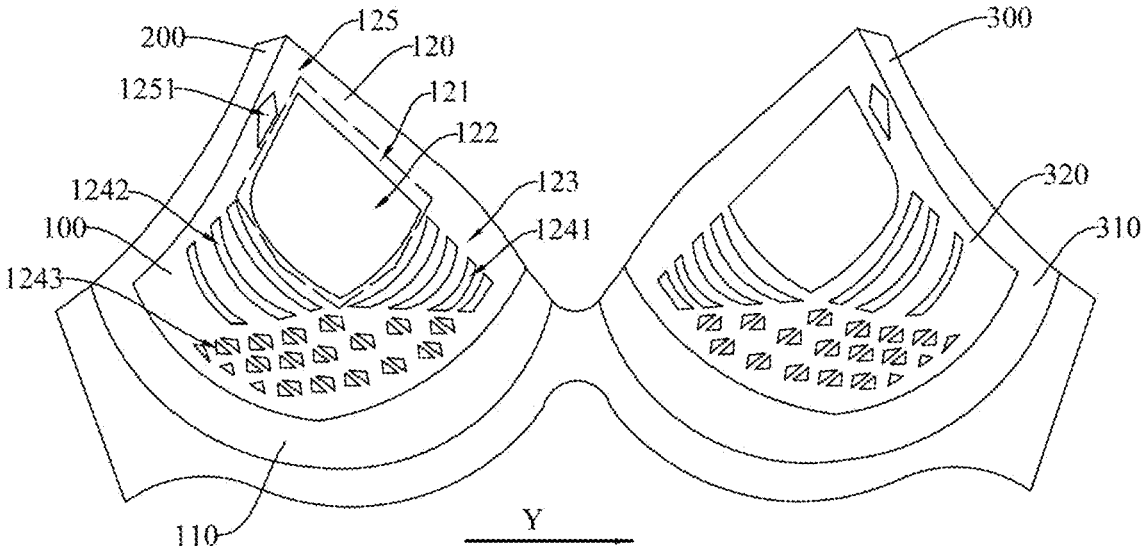
FIG. 1 illustrates a bra cup with cut openings structure in an embodiment of the present disclosure, where auxiliary openings include a first set of openings, a second set of openings and a third set of openings.

10 refers to brassiere;

100 refers to bra cup with cut openings structure;

110 refers to first base layer; 111 refers to first fabric layer; 112 refers to first foam layer; and 113 refers to first adhesive layer;

120 refers to first supporting layer; 121 refers to first region; 122 refers to main opening; 123 refers to second region; 124 refers to auxiliary opening; 1241 refers to first set of openings; 1242 refers to second set of openings; 1243 refers to third set of openings; 125 refers to third region; and 1251 refers to fourth set of openings;

130 refers to second base layer; 131 refers to second foam layer; and 132 refers to second fabric layer;

200 refers to first cup body;

300 refers to second cup body;

310 refers to third base layer; and 320 refers to second supporting layer;

X refers to first direction; and

Y refers to second direction.

The realization of object, the functional features and the advantages of the present disclosure are further described with reference to the drawings and the embodiments.

DETAILED DESCRIPTION

Technical solutions in embodiments of the present disclosure will be clearly and completely described hereinafter with reference to the drawings in the embodiments of the present disclosure. Obviously, the described embodiments are only some but not all of the embodiments of the present disclosure. Based on the embodiments of the present disclosure, all other embodiments obtained by those of ordinary skills in the art without going through any creative work shall fall within the scope of protection of the present disclosure.

Due to structural characteristics of the breasts, the breasts have different supporting requirements for different parts of bra cup. Specifically, upper and front sides of a breast require a small supporting force, and corresponding cup structures of the upper and front sides of the breast require high flexibility, while bottom and side of the breast require a large supporting force, and corresponding cup structures of the bottom and side of the breast require low flexibility and high supporting performance. In the existing technologies, the bra cup is often designed in an integrated way, and there is little difference between an overall flexibility and a supporting strength of the bra cup. If the bra cup has a large overall hardness and a strong supporting force, parts of the bra cup corresponding to the upper and front sides of the breast are easy to press the breast, and if the bra cup has a small overall hardness and a weak supporting force, the supporting forces of the bra cup corresponding to the bottom and sides of the breast will be too small to meet the requirement of shaping and supporting the breast, and an overall supporting effect of the bra cup will be reduced accordingly. Therefore, the support to the breasts by the bra cup in the existing technologies makes it difficult to meet the requirements for different supporting forces and flexibilities in various regions of the breasts, so that the bra cup has poor wearing experience.

In order to solve the above technical problems, as shown in FIG. 1 to FIG. 4, the present disclosure provides a bra cup with cut openings structure 100, and the bra cup with cut openings structure 100 includes a first base layer 110 and a first supporting layer 120.

As shown in FIG. 1, the first supporting layer 120 is stacked with the first base layer 110 in a first direction X, the first supporting layer 120 is provided with a first region 121 and a second region 123, the first region 121 is configured for fitting an upper side of a breast, the second region 123 is configured for fitting a bottom side of the breast, the first region 121 is provided with a main opening 122, the second region 123 is provided with auxiliary openings 124, and in a direction perpendicular to the first direction X, a projection area of a single main opening 122 on the first base layer is not smaller than a projection area of a single opening among the auxiliary openings 124 on the first base layer. According to different processing requirements, the main opening 122 and the auxiliary openings 124 may be processed by any suitable method. In an embodiment, the main opening 122 and the auxiliary openings 124 may be obtained by laser cutting. It should be noted that the main opening 122 and the auxiliary openings 124 in the first supporting layer 120 may be through openings or blind openings, which will not be limited herein. The first base layer 110 may be a fabric layer or a combination of multiple material layers. In order to facilitate cutting, the first supporting layer 120 may be configured as a foam layer.

In an embodiment of the present disclosure, the bra cup with cut openings structure 100 has the first region 121 and the second region 123, the first region 121 is provided with the main openings 122, the second region 123 is provided with the auxiliary openings 124, and in the direction perpendicular to the first direction X, the projection area of the single opening among the main openings 122 on the first base layer is not smaller than the projection area of the single opening among the auxiliary openings 124 on the first base layer. The first supporting layer 120 corresponding to the first region 121 defines the largest cut opening, such that the first region 121 has the least supporting material per unit area, and the supporting strength of the first region 121 is reduced and the flexibility of the first region is improved. The part of the bra cup with cut openings structure 100 corresponding to the first region 121 has good elasticity, such that the bra cup with cut openings structure 100 can better embrace and fit the upper side of the breast.

In the existing technologies, for some cups, in order to enhance a supporting effect of a center point of the cup, a part of the cup close to the front side of the breast has a large hardness, thereby the front side of the cup does not have sufficient elasticity and space, and the cup will press the breast during wearing, which not only has poor wearing aesthetics, but also leads to difficulty in breathing to affect health. In an embodiment of the present disclosure, an area of the single opening among the auxiliary cut openings 124 in the second region 123 is smaller than an area of the single opening among the main openings 122. On one hand, the arrangement of the auxiliary openings 124 can reduce a supporting material of the second region 123, improve the flexibility of the second region 123, enhance a fitting degree between the bra cup with cut openings structure 100 corresponding to the second region 123 and the breast, and reduce the pressing of the bra cup with cut openings structure 100 on the breast. On the other hand, compared with the main opening 122, the area of the single auxiliary opening close to the bottom side of the breast is small, the first supporting layer 120 has less removed material, and more supporting material per unit area is retained, such that the second region 123 can fit a breast and has a good supporting effect at the same time. The reasonable distribution of the cut openings in the first region 121 and the second region 123 makes the bra cup with cut openings structure 100 in embodiments of the disclosure have reasonable flexibility distribution, strong supporting ability and high wearing fit.

Figure 4:
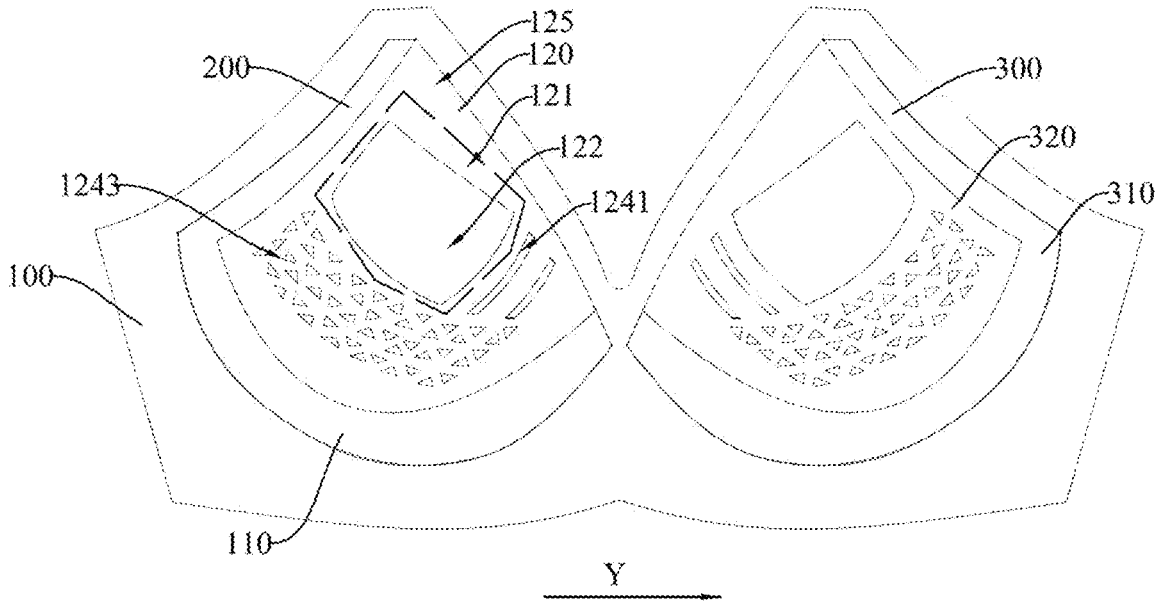
FIG. 4 illustrates the bra cup with cut openings structure in an embodiment of the present disclosure, where the auxiliary openings include the first set of openings and the third set of openings.

According to requirements for different flexibilities and supporting effects of different sizes of bra cups with cut openings structure 100, actual sizes and numbers of the main openings 122 and the auxiliary openings 124 may be different. In an embodiment, there may be a single main opening 122 only, and a projection area of the opening on the first base layer 110 in the first direction X is greater than a projection area of any auxiliary opening 124 on the first base layer. In an embodiment, there may also be a plurality of main openings 122, and a projection area of at least one of the plurality of openings on the first base layer 110 in the first direction X is greater than the projection area of any auxiliary opening 124 on the first base layer. Similarly, there may be one auxiliary opening 124 only, and there may also be a plurality of auxiliary openings 124. Preferably, as shown in FIG. 1, in the embodiment, the auxiliary openings 124 include a first set of openings 1241, a second set of openings 1242 and a third set of openings 1243. The first set of openings 1241 is arranged on a side of the main opening 122 close to a front side of the breast. The second set of openings 1242 is arranged on a side of the main opening 122 close to a side of the breast. The third set of openings 1243 is arranged on a side of the main opening 122 close to the bottom side of the breast. A set of openings refers to an array composed of a plurality of openings. The arrangement of the plurality sets of openings makes the flexibility of the second region 123 finer and more diversified, and the bra cup with cut openings structure 100 can have richer flexibility distribution, and supporting effects of various regions can be better adjusted at the same time. As shown in FIG. 4, in some embodiments, the auxiliary openings 124 include the first set of openings 1241 and the third set of openings 1243, the specific number of sets of openings included in the auxiliary openings 124 and numbers of openings in a set of openings may both be set according to different use requirements, which will not be limited herein.

In some embodiments, in order to adjust a flexibility of a bra cup with cut openings close to the front side of the breast, widths of various openings in the first set of openings 1241 may be different. Similarly, widths of various openings in the second set of openings 1242 may also be different. As shown in FIG. 1, in this embodiment, a second direction Y points from a side of the breast to a front side of the breast, and the second direction Y is perpendicular to the first direction X. The auxiliary openings 124 include the first set of openings 1241, and the first set of openings 1241 is arranged on a side of the main opening 122 close to the front side of the breast, and a width of an opening in the first set of openings 1241 close to the front side of the breast in the second direction Y is greater than a width of an opening in the first set of openings far away from the front side of the breast in the second direction Y. The auxiliary openings 124 include the second set of openings 1242, and the second set of openings 1242 is arranged on a side of the main opening 122 close to the side of the breast, and a width of an opening in the second set of openings 1242 close to the side of the breast in the second direction Y is not greater than a width of an opening in the second set of openings far away from the front side of the breast in the second direction Y. That is to say, a corresponding opening of the first set of openings 1241 has more removed supporting material in a unit area of a region close to the front side of the breast, and a corresponding opening of the second set of openings 1242 has less removed supporting material in a unit area of a region close to the side of the breast, so that flexibility of a region of the bra cup with cut openings structure 100 close to the front side of the breast is stronger than flexibility of a region of the bra cup with cut openings structure 100 close to the side of the breast. On the contrary, a supporting effect of the region of the bra cup with cut openings structure 100 close to the front side of the breast is lower than a supporting effect of the region of the bra cup with cut openings structure 100 close to the side of the breast. Therefore, the distribution of flexibility and supporting effect of the cup is further improved.

In order to adjust the flexibility and the supporting effect of the bra cup with cut openings structure 100, not only sizes and shapes of the openings may be designed according to different requirements, but also a distance between the openings may be adjusted according to different requirements. As shown in FIG. 1, in this embodiment, the auxiliary openings 124 include the first set of openings 1241 and the second set of openings 1242, the first set of openings 1241 is arranged on a side of the main opening 122 close to the front side of the breast, and the second set of openings 1242 is arranged on a side of the main opening 122 close to the side of the breast. the second direction Y points from the side of the breast to the front side of the breast, and the second direction Y is perpendicular to the first direction X. A distance between adjacent openings in the first set of openings 1241 in the second direction Y is not greater than a distance between adjacent openings in the second set of openings 1242 in the second direction Y. Specifically, in the second direction Y, the distance between adjacent openings in the first set of openings 1241 can be gradually reduced, and the distance between adjacent openings in the second set of openings 1242 can also be gradually reduced. A minimum distance between adjacent openings in the second set of openings 1242 may be greater than a maximum distance between adjacent openings in the first set of openings 1241. According to different design requirements, each of both the main openings 122 and the auxiliary openings 124 may be configured as any one or more of a quasi-quadrilateral opening, a circular opening, a heart-shaped opening, a star-shaped opening, a diamond-shaped opening, a triangular opening, a pentagonal opening, a hexagonal opening, an octagonal opening or a snowflake-shaped opening.

A stretching rate refers to a ratio of an elongation of an original gauge length to the original gauge length after stretching fracture of a sample. In some embodiments, the first region has a first stretching rate a, and the second region has a second stretching rate b. The first supporting layer also has a third region, the third region is arranged around the first region and the second region, and the third region has a third stretching rate c. The first stretching rate a, the second stretching rate b and the third stretching rate c satisfy that $c \leq b \leq a$. In an implementation, in order to ensure the supporting effect while satisfying the flexibility, the first region 121 may have the first stretching rate a, and the first stretching rate a satisfies that $0.4 \leq a \leq 0.7$. Specifically, the first stretching rate a may be any suitable value such as 0.4, 0.5, 0.65 or 0.7. The second region 123 may have the second stretching rate b, and the second stretching rate b satisfies that $0.3 \leq b \leq 0.6$. Specifically, the second stretching rate b may be any suitable value such as 0.3, 0.4, 0.45, 0.56 or 0.6. The first supporting layer 120 may also have a third region 125, the third region 125 is arranged around the first region 121 and the second region 123, the third region 125 has a third stretching rate c, and the third stretching rate c satisfies that $0.2 \leq c \leq 0.6$. The third stretching rate c may be any suitable value such as 0.2, 0.3, 0.45, 0.5 or 0.6. That is to say, in the first supporting layer 120, the third region 125 has the strongest supporting effect. It should be noted that the third region 125 may or may not define a cut opening, and a supporting effect of the first base layer 110 may be stronger than a supporting effect of the third region 125. When the third region 125 defines the cut opening, the cut openings in the third region 125 form a fourth set of openings 1251, and the openings of the fourth set of openings 1251 may be configured to enhance the air permeability of the bra cup and adjust a flexibility and a supporting effect of an edge of the bra cup with cut openings structure 100. Similarly, the main openings 122 and the auxiliary openings 124 can also improve the air permeability of the bra cup, which will not be repeated herein.

Figure 3:
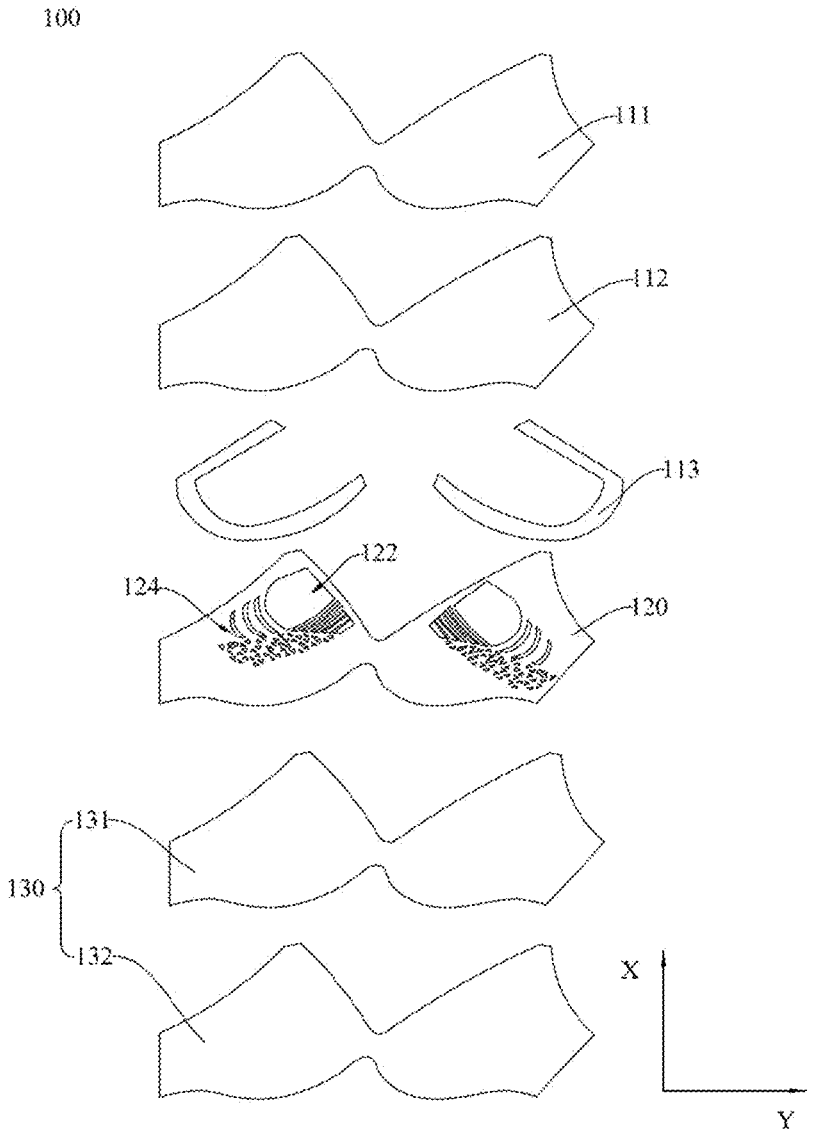
FIG. 3 illustrates the bra cup with cut openings structure in an embodiment of the present disclosure before various layers are stacked.

In the first direction X, the first base layer may be provided on a side of the first supporting layer 120, a second base layer may be provided on the other side of the first supporting layer, and the first base layer and the second base layer may both include a fabric, foam, a Mesh, tricot, adhesive, and the like. In the embodiment as shown in FIG. 1, the bra cup with cut openings structure 100 further includes the second base layer 130, the second base layer 130 is arranged on a side of the first supporting layer 120 far away from the first base layer 110, and the second base layer 130 covers the first supporting layer 120. The first base layer 110 includes a first fabric layer 111, a first foam layer 112 and a first adhesive layer 113 which are stacked, and the first adhesive layer 113 is configured for adhering the first foam layer 112 to the first supporting layer 120. If the first base layer 110 is configured for being in contact with the breast, the second base layer 130 is arranged on the side of the first supporting layer 120 far away from the breast. As shown in FIG. 3, in some embodiments, the second base layer 130 includes a second foam layer 131 and a second fabric layer 132, such that the bra cup with cut openings structure 100 may be provided with the first fabric layer 111, the first foam layer 112, the first adhesive layer 113, the first supporting layer 120, the second foam layer 131 and the second fabric layer 132 which are sequentially stacked in the first direction X. Under the gravity of the whole breast, the bottom side of the bra cup with cut openings structure 100 must have sufficient supporting force to support the breast, and the arrangement of a plurality of foam layers can effectively improve the supporting effect of the bra cup with cut openings structure 100. During processing, the adhesive layer can combine various layers closely, and after molding, the bra cup with cut openings structure 100 has thin thickness, good flexibility and high supporting effect, such that the bra cup with cut openings structure 100 can also provide sufficient support when there are different sizes. In addition, the first adhesive layer 130 may be made of a hot melt adhesive, polyurethane (PU), ethylene vinyl acetate (EVA), thermoplastic polyurethane (TPU), and the like, and various material layers may be bonded by heating the hot melt adhesive, and the like. Because of being composed of many soft segments and hard segments, the hot melt adhesive has the advantages of good elasticity, excellent elongation, and the like, and the hot melt adhesive has a low bonding cost and is conductive to eliminating the steps, fix tools and it dries faster, thus saving processing time, energy, and improving production efficiency, also greatly improving product quality.

In a manufacturing process, different materials may be provided for laser cutting, stacking and mold pressing to acquire the bra cup with cut openings structure 100. In an embodiment, in a first step, a suitable foam material may be selected according to different hardness and density, and the foam material is cut into appropriate size and shape by a mold or a cutting tool. In a second step, CAD and other software may be employed to define and optimize a pattern and a depth of the laser cutting, and then the first supporting layer 120 with the main openings 122 and the auxiliary openings is acquired by the laser cutting. Specifically, based on design requirements, a computer-controlled laser cutting system may be employed to obtain cut openings with different depths by adjusting laser parameters, such as laser power, a focal length, a speed and an intensity. In addition, in the present disclosure, the material to be subjected to the laser cutting may be placed on a vertical bottom plate which has a good air permeability and is convenient to clean and disassemble for cutting. A focal lens of a laser gun may also affect an accuracy of a size of the pattern of the laser cutting, and in an implementation, a focal lens with a focal length of 60° to 80° may be selected. The larger the focal length value of the focal lens is, the longer the focal point is, and the thicker the cut piece of the laser cutting is. The laser cutting system cuts the foam material through a high-precision laser beam according to predetermined pattern and parameters to form flexibly changed regions required. In a third step, the cut materials are stacked and assembled. There is the pattern of the laser cutting between a fabric decorative piece and a foam layer, so that a requirement for adhesion is quite high, which is because a contact surface is less than that of an ordinary mold cup. The arrangement of the hot melt adhesive can make the connection between various layers more stable. In addition, an appropriate glue or structural material fixes the stacked foam materials together, which can also improve a stability and a durability of a cup shape. In a fourth step, molding pressing is carried out. The stacked foam materials are placed in a mold to ensure that the stacked foam materials meet a requirement of the cup shape.

Figure 2:
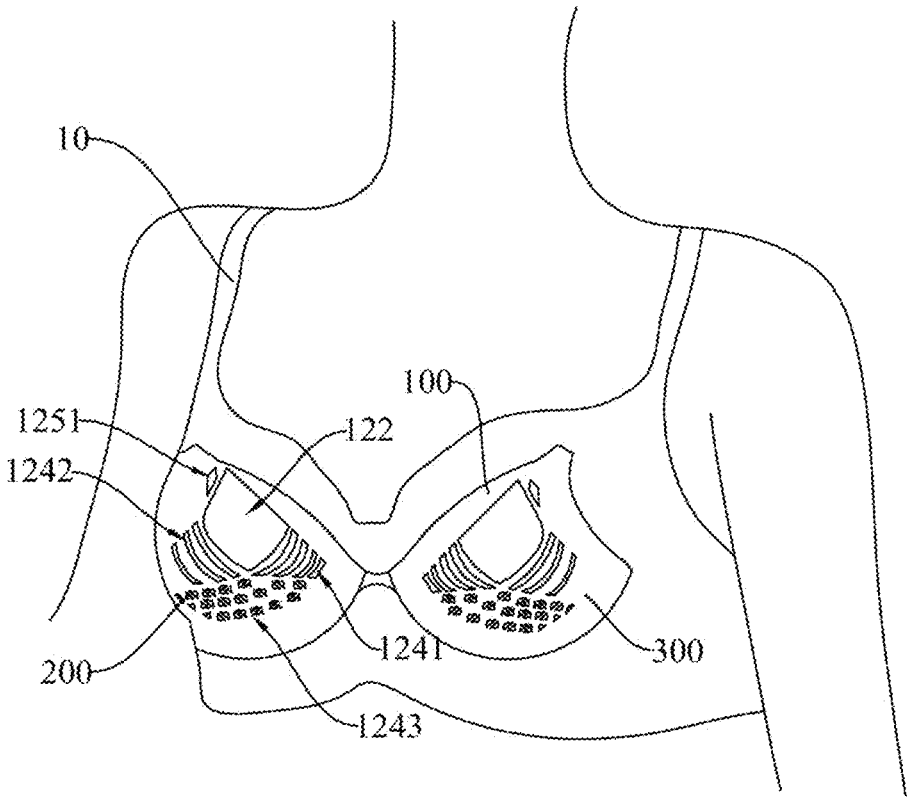
FIG. 2 illustrates a brassiere in an embodiment of the present disclosure.

As shown in FIG. 1 and FIG. 2, in some embodiments, the bra cup with cut openings structure 100 includes a first cup body 200 and a second cup body 300, the first cup body 200 includes the first base layer and the first supporting layer 120, the second cup body 300 includes a third base layer and a second supporting layer 320, and the second supporting layer 320 defines a fifth set of openings including a first subset of openings each symmetrically arranged with respect to a respective one of the several main openings 122, and a second subset of openings each symmetrically arranged with respect to a respective one of the several auxiliary openings 124. The first cup body 200 and the second cup body 300 may be respectively configured for supporting left and right breasts. The second cup body 300 defines the openings each symmetrical to the respective one of openings of the first cup body 200, and meanwhile, the second cup body 300 may have the same material layers as the first cup body 200, and the second cup body 300 has the same advantages as the first cup body 200, which will not be repeated herein.

As shown in FIG. 2, in a second aspect, the present disclosure further provides a brassiere 10, and the brassiere 10 includes the bra cup with cut openings structure 100 according to any one of the above embodiments. Based on the improvement of the bra cup with cut openings structure 100 above, the brassiere 10 in this embodiment has the same technical effects as the bra cup with cut openings structure 100 above, which will not be repeated herein.

It shall be noted that all directional indications (such as upper, bottom, left, right, front, back, etc.) in the embodiments of the present disclosure are only used to explain the relative positional relationship, movement condition, etc. among various components under a certain specific posture, and if the specific posture is changed, the directional indications are also changed accordingly.

Moreover, the descriptions related to "first", "second", etc. in the present disclosure are used for descriptive purposes only and cannot be understood as indicating or implying relative importance, or implicitly indicating the number of technical features indicated thereby. Thus, the feature defined by "first" and "second" may explicitly or implicitly include at least one of this feature. In addition, the meaning of "and/or" in the whole text includes three parallel solutions, for example, "A and/or B" refers to the solution that A satisfies, or the solution that B satisfies, or the solution that both A and B satisfy In addition, the technical solutions in the embodiments can be combined with each other, which shall be on the basis that the combination can be realized by those of ordinary skills in the art, when the combination of the technical solutions is contradictory or cannot be realized, it shall be considered that the combination of the technical solutions does not exist and does not fall within the scope of protection of the present disclosure.

The above are merely some embodiments of the present disclosure, but are not intended to limit the scope of the present disclosure. Under the conception of the present disclosure, all equivalent structural transformations made by using the specification of the present disclosure and the contents of the drawings, or used directly/indirectly in other related technical fields, are included in the scope of protection of the present disclosure.

What is claimed is:

1. A bra cup with cut openings structure, comprising:

a first base layer; and a first supporting layer stacked with the first base layer in a first direction, wherein the first supporting layer is provided with a first region and a second region, the first region is configured for fitting an upper side of a breast, the second region is configured for fitting a bottom side of the breast, the first region is provided with several main openings, the second region is provided with several auxiliary openings, and in a direction perpendicular to the first direction, a projection area of a single opening among the several main openings on the first base layer is not smaller than a projection area of a single opening among the several auxiliary openings on the first base layer.

2. The bra cup with cut openings structure according to claim 1, wherein, the several auxiliary openings are arranged in at least one of the following ways that:

the several auxiliary openings comprise a first set of openings, and the first set of openings is configured to be arranged on a side of the main opening close to a front side of the breast;

the several auxiliary openings comprise a second set of openings, and the second set of openings is configured to be arranged on a side of the main opening close to a side of the breast; or the several auxiliary openings comprise a third set of openings, and the third set of openings is configured to be arranged on a side of the main opening close to the bottom side of the breast.

3. The bra cup with cut openings structure according to claim 1, wherein, a second direction points from a side of the breast to a front side of the breast, and the second direction is perpendicular to the first direction;

wherein, the several auxiliary openings are arranged in at least one of the following ways that:

the several auxiliary openings comprise a first set of openings, and the first set of openings is configured to be arranged on a side of the main opening close to a front side of the breast, and a width of an opening in the first set of openings close to the front side of the breast in the second direction is greater than a width of an opening in the first set of openings far away from the front side of the breast in the second direction; or the several auxiliary openings comprise a second set of openings, and the second set of openings is configured to be arranged on a side of the main opening close to the side of the breast, and a width of an opening in the second set of openings close to the side of the breast in the second direction is not greater than a width of an opening in the second set of openings far away from the front side of the breast in the second direction.

4. The bra cup with cut openings structure according to claim 1, wherein, the several auxiliary openings comprise a first set of openings and a second set of openings, the first set of openings is configured to be arranged on a side of the main opening close to a front side of the breast, the second set of openings is configured to be arranged on a side of the main opening close to a side of the breast, a second direction points from the side of the breast to the front side of the breast, and the second direction is perpendicular to the first direction.

5. The bra cup with cut openings structure according to claim 1, comprising at least one of following configurations in which, each of the several main openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening or a snowflake-shaped opening; or each of the several auxiliary openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening or a snowflake-shaped opening.

6. The bra cup with cut openings structure according to claim 1, wherein, the first region has a first stretching rate a, the second region has a second stretching rate b, the first supporting layer further has a third region, the third region is arranged around the first region and the second region, the third region has a third stretching rate c, and the first stretching rate a, the second stretching rate b and the third stretching rate c satisfy that $c \leq b \leq a$.

7. The bra cup with cut openings structure according to claim 1, wherein, the bra cup with cut openings structure further comprises a second base layer, the second base layer is arranged on a side of the first supporting layer far away from the first base layer, and the second base layer covers the first supporting layer.

8. The bra cup with cut openings structure according to claim 7, wherein, the first base layer comprises a first fabric layer, a first foam layer and a first adhesive layer which are stacked, and the first adhesive layer is configured for adhering the first foam layer to the first supporting layer.

9. The bra cup with cut openings structure according to claim 1, wherein, the bra cup with cut openings structure comprises a first cup body and a second cup body, the first cup body comprises the first base layer and the first supporting layer, the second cup body comprises a third base layer and a second supporting layer, and the second supporting layer defines a fifth set of openings comprising a first subset of openings each symmetrically arranged with respect to a respective one of the several main openings, and a second subset of openings each symmetrically arranged with respect to a respective one of the several auxiliary openings.

10. A brassiere, comprising a bra cup with cut openings structure, wherein the bra cup with cut openings structure comprises:

a first base layer; and a first supporting layer stacked with the first base layer in a first direction, wherein the first supporting layer is provided with a first region and a second region, the first region is configured for fitting an upper side of a breast, the second region is configured for fitting a bottom side of the breast, the first region is provided with several main openings, the second region is provided with several auxiliary openings, and in a direction perpendicular to the first direction, a projection area of a single opening among the several main openings on the first base layer is not smaller than a projection area of a single opening among the several auxiliary openings on the first base layer.

11. The brassiere according to claim 10, wherein, the several auxiliary openings are arranged in at least one of the following ways that:

the several auxiliary openings comprise a first set of openings, and the first set of openings is configured to be arranged on a side of the main opening close to a front side of the breast;

the several auxiliary openings comprise a second set of openings, and the second set of openings is configured to be arranged on a side of the main opening close to a side of the breast; or the several auxiliary openings comprise a third set of openings, and the third set of openings is configured to be arranged on a side of the main opening close to the bottom side of the breast.

12. The brassiere according to claim 10, wherein, a second direction points from a side of the breast to a front side of the breast, and the second direction is perpendicular to the first direction;

wherein, the several auxiliary openings are arranged by at least one of the following ways that:

the several auxiliary openings comprise a first set of openings, and the first set of openings is configured to be arranged on a side of the main opening close to a front side of the breast, and a width of an opening in the first set of openings close to the front side of the breast in the second direction is greater than a width of an opening in the first set of openings far away from the front side of the breast in the second direction; or the several auxiliary openings comprise a second set of openings, and the second set of openings is configured to be arranged on a side of the main opening close to the side of the breast, and a width of an opening in the second set of openings close to the side of the breast in the second direction is not greater than a width of an opening in the second set of openings far away from the front side of the breast in the second direction.

13. The brassiere according to claim 10, wherein, the several auxiliary openings comprise a first set of openings and a second set of openings, the first set of openings is configured to be arranged on a side of the main opening close to a front side of the breast, the second set of openings is configured to be arranged on a side of the main opening close to a side of the breast, a second direction points from the side of the breast to the front side of the breast, and the second direction is perpendicular to the first direction.

14. The brassiere according to claim 10, comprising at least one of following configurations in which, each of the several main openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening or a snowflake-shaped opening; or each of the several auxiliary openings is configured as any one of a quasi-quadrilateral opening, a circular opening, a heart-shaped opening, a star-shaped opening, a diamond-shaped opening, a triangular opening, a pentagonal opening, a hexagonal opening, an octagonal opening or a snowflake-shaped opening.

15. The brassiere according to claim 10, wherein, the first region has a first stretching rate a, the second region has a second stretching rate b, the first supporting layer further has a third region, the third region is arranged around the first region and the second region, the third region has a third stretching rate c, and the first stretching rate a, the second stretching rate b and the third stretching rate c satisfy that $c \leq b \leq a$.

16. The brassiere according to claim 10, wherein, the bra cup with cut openings structure further comprises a second base layer, the second base layer is arranged on a side of the first supporting layer far away from the first base layer, and the second base layer covers the first supporting layer.

17. The brassiere according to claim 16, wherein, the first base layer comprises a first fabric layer, a first foam layer and a first adhesive layer which are stacked, and the first adhesive layer is configured for adhering the first foam layer to the first supporting layer.

18. The brassiere according to claim 10, wherein, the bra cup with cut openings structure comprises a first cup body and a second cup body, the first cup body comprises the first base layer and the first supporting layer, the second cup body comprises a third base layer and a second supporting layer, and the second supporting layer defines a fifth set of openings comprising a first subset of openings each symmetrically arranged with respect to a respective one of the several main openings, and a second subset of openings each symmetrically arranged with respect to a respective one of the several auxiliary openings.

* * * * *